United States Patent [19]

McGlothlin

[11] 3,968,655

[45] July 13, 1976

[54] METHOD OF REINFORCING TUNNELS BEFORE EXCAVATION

[76] Inventor: William K. McGlothlin, 1040 48th Ave., Greeley, Colo. 80631

[22] Filed: Mar. 4, 1975

[21] Appl. No.: 555,242

Related U.S. Application Data

[63] Continuation of Ser. No. 379,124, July 13, 1973, abandoned.

[52] U.S. Cl. ..... 61/42; 61/45 R

[51] Int. Cl.[2] ..... E01G 3/00

[58] Field of Search ..... 61/42, 45 R, 84, 85, 61/43

[56] References Cited

UNITED STATES PATENTS

| | | | |
|---|---|---|---|
| 3,508,406 | 4/1970 | Fisher | 61/45 R |
| 3,631,680 | 1/1972 | Thomson | 61/42 |

FOREIGN PATENTS OR APPLICATIONS

| | | | |
|---|---|---|---|
| 1,809,326 | 6/1970 | Germany | 61/42 |

*Primary Examiner*—Paul R. Gilliam
*Assistant Examiner*—Alex Grosz
*Attorney, Agent, or Firm*—Edwin L. Spangler, Jr.

[57] ABSTRACT

This invention relates to a method of reinforcing tunnels which comprises driving a crown drift along the top of the proposed tunnel, driving a pair of wall plate drifts along opposite sides of the proposed tunnel in spaced substantially parallel relation beneath and to one side of the crown drift, drilling a longitudinally spaced aligned or staggered series of small diameter bores downwardly and outwardly in both directions from within the crown drift along the ceiling of the proposed tunnel, drilling other series of similar bores upwardly from within the wall plate drifts along the walls of the proposed tunnel, said ceiling and wall bordering bore patterns being inclined toward one another and of a length such as to produce a skewed overlapped relation, inserting reinforcing rods into the bores of each series thereof so as to produce a metal curtain between drifts bordering the perimeter of the proposed tunnel, grouting the rods permanently in place within their respective bores, filling the drifts back up with concrete and removing the material within the arch defined by the refilled drifts and metal curtain therebetween. The invention also encompasses a method wherein the additional steel curtains are erected to reinforce the tunnel walls that extend downwardly from the floor of the wall plate drifts to a position outside the foot drifts driven along the base thereof.

5 Claims, 3 Drawing Figures

METHOD OF REINFORCING TUNNELS BEFORE EXCAVATION

Figure 3:
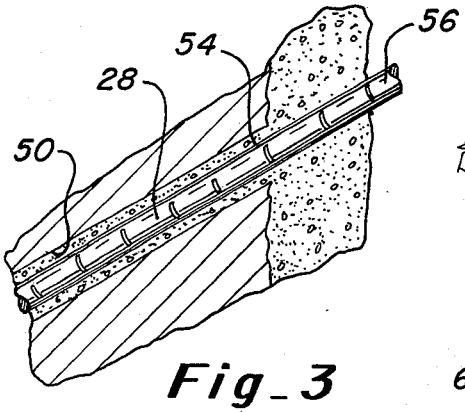

This is a continuation of application Ser. No. 379,124, filed July 13, 1973, now abandoned.

Ordinarily, tunnels driven through rock as opposed to dirt and other natural formations having little structural integrity pose no particular problem as witnessed by the fact the mountanous areas throughout the world are honeycombed with tunnels dug out and otherwise driven by those who, for the most part, possessed no engineering training whatsoever. While cave-ins were, and still are, a problem even in hard-rock tunneling, probably the use of dynamite and the presence of noxious and sometimes explosive gase mixtures constituted a far greater hazard.

Occasionally, however, rock is encountered within a tunnel which is so fractured, pulverized and otherwise weakened that is wholly incapable of supporting the loads imposed by the overburden thereabove when a part of it is removed. When such a condition is encountered in some section of a tunnel being driven, the customary procedure has been to erect an uninterrupted poured concrete arch extending up both sides and across the top from the inside of which the material is ultimately removed to form the tunnel. This continuous arch is formed by a stacked series of concrete "benches" formed by boring a succession of longitudinally extending individual drifts around the outside of the tunnel to be bored which are, eventually, filled with concrete. Such a method produces what is commonly known among hard rock tunnel experts and miners as a "fully stacked drift tunnel" and it amounts to just about the ultimate in tunnel construction. For instance, the cost of fully stacked drift tunnels often runs $20,000 per running foot.

It has been found in accordance with the teaching of the instant invention that the several advantages of a fully stacked drift tunnel can, in fact, be realized at a small fraction of the cost of the latter by the simple, but unobvious expedient of bridging between at least the crown and wall plate drifts with a single or multi-layered curtain of skewed and overlapped series of longitudinally spaced reinforcing rods extending downwardly and outwardly along the ceiling of the proposed tunnel from the crown drift and upwardly along the walls thereof from the wall plate drifts. Where necessary, similar single or multi-layered series of reinforcing rods can be used to bridge the section of tunnel wall left between a pair of foot drifts at the base of the proposed tunnel and the wall plate drifts. Since a concrete filled drift or "bench" runs about $800 per running foot and as many as 25 are required for a fully stacked tunnel drift, the cost of driving a tunnel by the present method is considerably less expensive in that only the crown and wall plate drifts are filled to define concrete benches and the foot drifts are left open which means that the cost of completing the latter is reduced by as much as $300 per running foot. When one adds to the basic cost of 3 × $800 (one crown and two wall plate drifts) plus 2 × $500 (2 foot drifts), the cost of drilling the rebar holes and the cost of the rebar itself, the total cost per running foot of a tunnel section formed in accordance with the instant method is only around $3,500 per running foot or slightly higher depending upon the rod spacing and whether a single or multilayered rod curtain is employed. The time it takes to drive a tunnel by the method forming the subject matter hereof is, likewise, only a fraction of that needed for a fully stacked tunnel drift.

In actual use, a staggered series of 20 foot long, 3 inch diameter reinforcing rods, two of which were joined together end to end and inserted anywhere from a minimum of 9 inches apart up to a couple of feet or more proved so effective that the rock face between the benches never broke back behind the innermost curtain defined thereby when the main tunnel was driven. No attempt was made to drill the rebar bores from the adjacent drifts so as to intersect one another; instead, care was taken to insure that the direction and depth of the bores was such that they passed alongside each other to produce a skewed and overlapped relation therebetween.

It is, therefore, the principal object of the present invention to provide a novel and improved method for reinforcing tunnels driven through unsafe rock formations.

A second objective of the invention is to provide a method of the class described which is considerably less expensive than prior art methods capable of correcting the same condition.

Another object of the within-described invention is to provide a tunnel reinforcing method wherein the foot drifts need not be filled with concrete as in tunnels reinforced by the fully stacked drift method.

An additional objective is the provision of a method for holding rock in place on the perimeter of a tunnel that is quite versatile and capable of being applied to only those particular sections where the unsafe condition exists.

Further objects are to provide a method of preventing tunnel cave-ins preparatory to permanently shoring same which is relatively simple and easily applied, requires no special tools or equipment, is reliable and readily adapted to use by any engineer skilled in hard rock mining and tunneling techniques.

Figure 1:
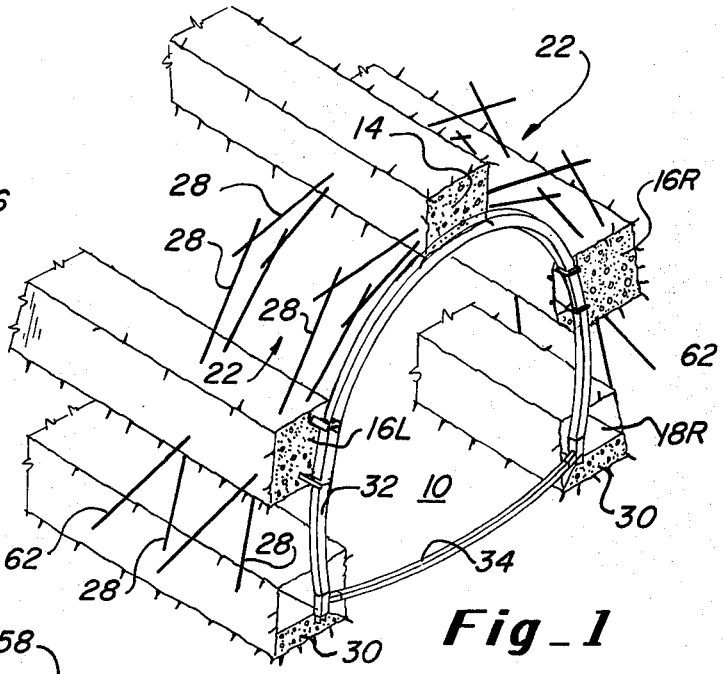
Figure 2:
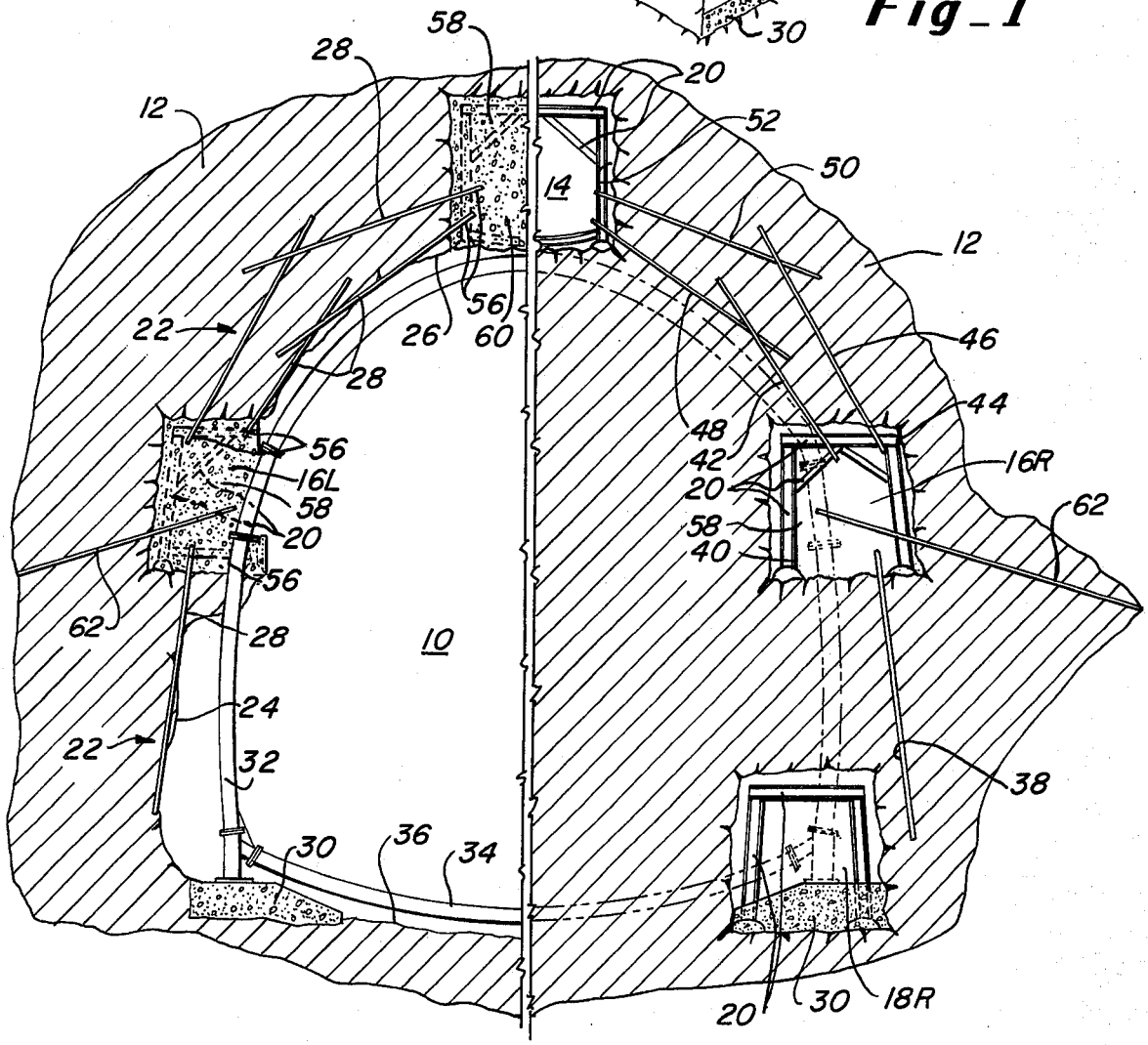

Other objects will be in part apparent and in part pointed out specifically hereinafter in connection with the description of the drawings that follows, and in which:

FIG. 1 is a fragmentary perspective view looking down upon a section of tunnel reinforced in accordance with the teaching of the present invention from a vantage point located in front of and to the left side of the entrance thereto;

FIG. 2 is a transverse section of the tunnel to an enlarged scale showing on the right half the open drifts, reinforcing rods and drift shoring prior to refilling the crown and wall plate drifts and excavation of the main tunnel whereas, the left half reveals the excavated tunnel complete with shoring and the steel curtain defined by the reinforcing rods; and, FIG. 3 is a further enlarged fragmentary section showing one of the reinforcing rods grouted in place.

Referring next to the drawings for a detailed description of the present invention, reference numeral 10 has been chosen to designate the main tunnel which is driven through hard rock 12 by conventional hard rock mining techniques insofar as excavation thereof is concerned. Reference numeral 14 designates the crown drift atop the proposed tunnel while numerals 16R and 16L designate the right and left wall plate drifts, respectively, and numeral 18R the right foot drift, the left one having become a part of the main tunnel. All of these drifts are, of course, driven in accordance with the same hard rock mining methods used in driving the main tunnel.

As these drifts are driven, they are shored at intervals with timbers 20 in the well known manner to prevent cave-ins. In so-called "bad rock" of the type in which the instant tunnel reinforcing method is employed, extra precautions must, of necessity, be taken to adequately shore the drifts; however, such is well within the skill of an experienced mining engineer and it is only of incidental significance to the present invention as it must be practiced along with the novel steps of the method.

The foot drifts 18 are, likewise, of conventional construction and, in the particular form of the invention illustrated, no part of the steel curtain which has been designated broadly by reference numeral 22 originates within the latter although there is no reason why it could not do so. In other words, the side walls 24 of the main tunnel 10 can be reinforced to the extent needed from the wall plate drifts 16 as will be explained presently; whereas, the arched ceiling 26 of the main bore is more difficult to reinforce due to the lack of any supporting structure therebeneath and, as such, both the wall plate and crown drifts must be used in erecting an effective curtain of reinforcing rods 28. The foot drifts are shored in much the same way as the other drifts but, instead of filling them with concrete, footings 30 are poured in the bottom thereof atop which are eventually erected the main steel arches 32 within the confines of which the finished tunnel is finally formed in the conventional manner. Steel joist-like members 34 span the tunnel over the bed or floor 36 thereof from their points of attachment at the feet of the arches 32.

Before any work can begin on the excavation of the main tunnel, however, that portion of the overburden which will eventually define the ceiling and side walls thereof must be reinforced to the extent where it can be relied upon to stay in place and not cave in. It is the latter which forms the subject matter of the present invention and it is accomplished in accordance therewith by first driving the crown drift and a pair of wall plate drifts below and on opposite sides of the latter. After shoring these drifts in the usual way as previously mentioned, the walls 24 of the main tunnel are reinforced by drilling a series of small diameter bores 38 down through the floor 40 of the wall plate drifts at intervals throughout its length as shown on the right half of FIG. 2. These bores should be placed so as to define the approximate maximum outer limit desired for the natural side walls of the main tunnel excavation. In other words, in the design of such a tunnel, the engineers will ordinarily determine certain maximum dimensions that should not be exceeded even though the actual excavated dimensions thereof may be appreciably less. Therefore, the side wall bore holes 38 should, preferably, be placed at that point in the rock which, presumably, establishes the outer limit of the main rough bore in case unwanted spiling should occur beyond that which is intentionally excavated. The term "rough bore" as used above is intended to define the main bore before it is shored with the steel arches 32 and finished off with a concrete lining (not shown).

The longitudinal spacing of the side wall bores 38 is a matter of choice and depends almost entirely on the condition of the rock at the point in question, the poorer the rock the closer the spacing. For instance, in particularly bad rock, the side wall bores may only be a few inches apart; whereas, under better conditions, a spacing of several feet may be quite adequate. Furthermore, since the condition of the rock will seldom, if ever be uniform throughout the length of the tunnel, the sidewall bore spacing may vary from section to section and change every few feet or so.

A single row of side wall bores 38 is generally all that is needed in the side walls 24 as the loads tending to cave them in are considerably less than overhead. Be that as it may, a second or even a third row of bores behind the one shown can be added in the same manner as shown in the ceiling which will be described shortly should the conditions demand this extra measure of cave-in protection through wall reinforcement. To date, however, no conditions have been encountered where a second or third row of wall bores is needed.

In the same manner, an inner row of upwardly directed ceiling bores 42 are drilled at an angle through the roof or ceiling 44 of each wall plate drift as shown in the right-hand half of FIG. 2. A second row 46 behind the first provides additional protection and should be used where conditions warrant same. In fact, a third row (not shown) could, conceivably be required under extremely adverse conditions even though no instance has yet occurred where the overburden broke back of the first row, yet alone the second or subsequent ones.

Similar rows of downwardly and outwardly directed ceiling bores 48 and 50 are drilled at an angle through the opposite side walls 52 of the crown drift along what will eventually become the ceiling 26 of the rough main tunnel bore. Here again, the outermost rows of ceiling bores 46 and 50 should be placed at approximately the maximum outer limit which the engineers determine can be tolerated for the main rough bore while the inner rows 42 and 48 are spaced inwardly of the latter by several feet. Due to the loads imposed by the overburden, the ceiling bores should preferably be no farther apart than, say approximately 4 feet. As far as a minimum spacing requirement is concerned, it becomes a practical one of leaving enough rock between bores to remain self-supporting. In other words, it is obvious that a row of tangent bores would cut the rock face free and leave only the curtain of rods to support the overburden. Even closely-spaced bore holes are likely to result in the rock therebetween being fractured as they are drilled. A practical minimum, therefore, would seem to be something around 6 inches even though the smallest interval tried to date has been 9 inches.

The length of the bores is, once again, subject to considerable latitude although the corresponding rows from the wall plate and crown drifts should, preferably, be of a length to pass one another in overlapping skewed relation as shown. Saying this another way, the terminal or blind ends of each row of upwardly directed inner and outer bores 42 and 46 should reach well past the corresponding ends of the downward direction companion bores 48 and 50 if the maximum reinforcing effect is to be achieved on the overburden at the perimeter of the tunnel. In fact, insofar as is practical, each bore including even the sidewall bores 38 should reach well over halfway to the adjoining drift and, preferably, terminate fairly close to the latter.

In the case of the intersecting rows of ceiling bores, the individual bores should not be made to intersect one another because, if they do, one of the rods cannot be inserted to the bottom of its bore hole. A skewed relationship has proven quite satisfactory thus far. Also, the several bores in a given row needn't be aligned or even parallel to one another and a staggered or otherwise misaligned relationship between the bores in a given row thereof seems to produce the desired results just as well as a coplanar row of essentially parallel bores. Conversely, no advantage is gained through misalignment of the bores in each row and aligning same has certain practical, if not functional, advantages.

Next, directing the attention to FIG. 1, the left half of FIG. 2 and FIG. 3, it will be seen that long steel reinforcing rods 28 are inserted into each of the several bores and then grouted in place with concrete 54. As indicated the length of the bores and the rods 28 inserted therein are such that the latter won't fit inside the drifts at the angle necessary for insertion, therefore, the rods must be brought in in sections and joined together as they are lowered down into their boxes. Ordinarily, two 20 foot sections are joined together making, obviously, a total rod length of about 40 feet. As shown, the bore holes are somewhat shallower than the rods are long so as to leave the inner ends 56 thereof projecting back into the drifts. This has the advantage of securely anchoring the inner ends of each reinforcing rod to the large concrete benches 58 and 60 formed when the drift is backfilled with concrete, the latter being the final step in the reinforcing method and that which takes place preparatory to excavating the main tunnel.

The diameter of the bore holes must, of necessity, be slightly oversize to insure that the heavy steel reinforcing rods which are virtually unbendable for all practical purposes can be inserted all the way to the bottom of the holes which are seldom perfectly straight. This same oversized relationship leaves enough space around, or at least adjacent, the rods to receive the grout which bonds same tightly to the rock.

Next, brief mention should be made of the anchor bolts 62 that extend more nearly horizontally from the wall plate drifts 16 out into the peripheral rock faces alongside the main tunnel. These bolts are widely used to anchor the wall plate benches 58 to the side walls of the tunnel and, as such, they perform no reinforcing function as the term is used here.

Finally, once the above-described operations are completed, the main tunnel can be excavated in accordance with customary practices currently in use in the hard rock tunneling art. At no time has the overburden, regardless of its condition, broken back beyond the innermost steel curtain although, on occasion, it has "spiled" to a point where the surfaces of some of the rods have been exposed to view prior to lining and scaling the main bore. The finishing operations are conventional and need not be discussed in detail.

What is claimed is:

1. The method of reinforcing the perimeter rock bordering a tunnel formed through rock preparatory to excavating same which comprises the steps of: excavating a crown drift along the top of the proposed tunnel, excavating a pair of wall plate drifts along opposite sides of the proposed tunnel in spaced substantially parallel relation beneath and to the sides of the crown drift, drilling a longitudinally spaced series of small diameter bores downwardly and outwardly in both directions from within the crown drift along the ceiling of the proposed tunnel, drilling other series of similar bores upwardly from within the wall plate drifts along the walls of the proposed tunnel, inserting reinforcing rods into the bores of each series thereof a distance at least half way but less than all the way to the adjacent drift, said rods cooperating to define a metal curtain between drifts bordering the perimeter of the proposed tunnel, grouting the rods permanently in place within their respective bores, and filling the drifts with concrete.

2. The method as set forth in claim 1 wherein the bores of each series are staggered so as to define two or more rows thereof lying one behind another.

3. The method as set forth in claim 1 which includes driving a pair of foot drifts on opposite sides of the proposed tunnel in spaced parallel relation beneath the wall plate drifts, drilling still other series of similar bores from within said wall plate drifts downwardly to a position alongside the foot drifts on the outside thereof, inserting reinforcing rods into these last-mentioned series of bores, and grouting same permanently in place.

4. The method as set forth in claim 1 wherein the bore hole spacing in each series is not greater than approximately 4 feet.

5. The method as set forth in claim 1 wherein the bore-hole spacing is not less than that necessary to prevent the overburden therebetween from breaking away.

* * * * *